United States Patent [19]

Antonov et al.

[11] Patent Number: 4,487,397

[45] Date of Patent: Dec. 11, 1984

[54] METHOD FOR FLAME SPRAYING OF GUNITE ON LINING OF METALLURGICAL UNITS

[75] Inventors: Veniamin V. Antonov; Jury I. Bat, both of Donetsk; Edvin I. Gamalei, Temirtau; Fedor E. Dolzhenkov, Donetsk; Semen A. Donskoi, Temirtau; Valentin A. Kulichenko, Temirtau; Oleg I. Tischenko, Temirtau; Evgeny D. Shtepa; Viktor M. Chervonenko, both of Donetsk, all of U.S.S.R.

[73] Assignee: Donetsky Nauchno-Issledovatelsky Institut Chernoi Metallurgii, Donetsk, U.S.S.R.

[21] Appl. No.: 227,064

[22] PCT Filed: Feb. 13, 1980

[86] PCT No.: PCT/SU80/00024

§ 371 Date: Dec. 18, 1980

§ 102(e) Date: Dec. 18, 1980

[87] PCT Pub. No.: WO80/02320

PCT Pub. Date: Oct. 30, 1980

[30] Foreign Application Priority Data

Apr. 16, 1979 [SU] U.S.S.R. ..... 2745351

[51] Int. Cl.[3] ..... C21C 5/44

[52] U.S. Cl. ..... 266/44; 266/280; 266/281; 264/30

[58] Field of Search ..... 75/0.5 B, 0.5 BB; 266/280, 281, 48, 44, 50, 57, 286; 239/398, 79, 85, 422, 424; 427/423, 233; 264/30, 80, 270; 118/47, 302

[56] References Cited

U.S. PATENT DOCUMENTS

| | | | |
|---|---|---|---|
| 3,083,289 | 3/1963 | Munro et al. | 118/302 |
| 3,883,078 | 5/1975 | Chemeris et al. | 239/422 |
| 3,911,175 | 10/1975 | Chemeris et al. | 266/281 |
| 4,192,460 | 3/1980 | Matsuo | 264/30 |

FOREIGN PATENT DOCUMENTS

| | | | |
|---|---|---|---|
| 0532022 | 10/1956 | Canada | 427/423 |
| 2200667 | 7/1973 | Fed. Rep. of Germany . | |

OTHER PUBLICATIONS

*Metallurg.*, 1977, No. 12, p. 26.

*Primary Examiner*—L. Dewayne Rutledge
*Assistant Examiner*—S. Kastler
*Attorney, Agent, or Firm*—McAulay, Fields, Fisher, Goldstein & Nissen

[57] ABSTRACT

A method for flame spraying of gunite on the lining of metallurgical units, comprising a delivery of a mixture of a refractory material and fuel in a central axisymmetric flow and a delivery of oxygen in an annular flow concentric with the flow of the refractory material and fuel, a heating and fusion of the refractory material in a high-temperature flame, and applying particles of the refractory material to the surface of the lining. Oxygen is delivered in a tapering annular flow rotating about its axis. The ratio between the rotation momentum of the oxygen flow and the momentum of the flow of the refractory and fuel is maintained in the range of 0.3 to 3.0.

3 Claims, 2 Drawing Figures

METHOD FOR FLAME SPRAYING OF GUNITE ON LINING OF METALLURGICAL UNITS

FIELD OF THE INVENTION

The present invention relates to ferrous metallurgy and, more particularly, to methods for flame spraying of gunite on the lining of metallurgical units.

BACKGROUND OF THE INVENTION

Damaged lining of metallurgical units is normally patched by using what is known as wet and semidry guniting techniques which consist in applying a moistened powdered refractory mass to a damaged area of the lining. Needless to say, the metallurgical unit is allowed to cool before patching. This type of lining repair takes much time, and the life of the lining is quite limited; the reason for this lies in the fact that the heat resistance of the refractory mass is reduced by additives which serve to ensure a desired degree of plasticity of the mass in the cold state. For example, a magnesite- or dolomite-based refractory mass used for the patching of damaged converter lining has to contain silicate-based additives. Such a patching material differs in composition from the lining material; additives contained in the patching material react with the lining material to produce compounds whose refractoriness is lower than that of the original lining material; a patching mass of this type does not adhere well enough to the original lining and is not as resistant to the chemcial attack of slag as the original lining material.

The most effective patching technique is the flame spraying of gunite on the lining of metallurgical units. This method consists in feeding a refractory material, fuel and oxygen to the lining, burning the fuel in an oxygen flame, heating particles of the refractory material caught in the flame to a temperature at which they assume a plastic state, and applying the plastic particles of the refractory material to the linings under repair.

There are known a method and device for flame guniting of converter lining. According to this method, the refractory and fuel are both powdered materials which are fed to the lining together. A jet carrying the refractory, fuel and oxygen is directed tangentially to the surface of the converter lining (Cf. FRG Pat. No. 2,200,667, Cl. C 21 C, 5/44/, published May 13, 1976).

The tangential positioning of the flame relative to the lining surface is disadvantageous in that the patching is not good enough, since much of the refractory material is carried away as dust with the discharged combustion products. The latter, in turn, is due to incomplete combustion and also to the fact that a rarefield zone is produced in the center of the rotating dust-carrying gas jet, which zone attracts both gases and particles of the refractory material. With a tangential positioning of the flame relative to the lining surface, the distance between the ends of the nozzles and the lining is not enough to ensure complete fuel combustion; as a result, the heating is inadequate to plasticize the refractory material. The patching material thus contains refractory particles which poorly fuse with one another and with the original lining material. The poorly heated refractory material does not adhere to the lining and is carried away with the combustion products.

There is also known a method for flame spraying the lining of metallurgical units, wherein a mixture of a refractory material, fuel and oxygen is directed at a perpendicular or at an angle to the surface of the lining that needs patching. As a result, the refractory material is softened by the high-temperature flame; the additives contained in the refractory material and fuel are fused, and wet the lining surface and the particles of the refractory material in the flame. Particles of the refractory material are projected against the lining surface at an angle close to 90°, and the refractory adheres effectively to the lining.

The art closest to the present invention is the flame spraying method, wherein a jet of fuel and refractory material and a jet of oxygen are directed at a perpendicular to the surface of the lining in need of patching. This method is carried out with the aid of a tuyere formed with channels for separate feeding of compressed oxygen and a powdered mixture of refractory and fuel to respective nozzles extending along the tuyere wall.

The mixture of refractory and fuel is passed through a central nozzle with oxygen being fed through an annular channel between the nozzles. The mixture comprises 20 to 30 percent by weight of fuel and 70 to 80 percent by weight of magnesite (cf. the journal "Metallurg", Metallurgia Publishers, Moscow, 1977, No 12, pp. 25–26).

The latter method has the disadvantage that it does not provide for the uniform heating of all the refractory particles in the flame; furthermore, it does not ensure equal speeds of refractory particles directed at the lining surface, because the fuel combustion zone is extended along the flame; the asymmetric flow of fuel and refractory material does not mix well enough with the annular flow of oxygen; and the distribution of concentrations and temperatures is not uniform over the cross-section of the flame. With the two-phase mixture of fuel and refractory material delivered in the form of a central jet and oxygen delivered as an annular jet, the concentration of fuel and refractory material is higher in the middle of the cross-sectional area of the flame than on the flame periphery. On the contrary, the oxygen concentration is higher on the periphery of the flame than in its center. Combustion is not completed over the short period of time it takes a particle to reach the lining; as a result, part of the refractory material is not heated so that it can assume a plastic state poorly heated refractory particles are entrained as dust in the outgoing flow of combustion products. The resultant patching is not durable enough, because also, poorly heated refractory particles that reach the lining surface do not effectively fuse with one another and with the lining material, which affects the bonds between grains of the patching material. With the mixture of fuel and refractory material delivered in a flow parallel to the flow of oxygen, the amount of refractory material adhering to the lining is never higher than 60 to 70 percent of the total amount of refractory material used for the patching.

OBJECTS AND SUMMARY OF THE INVENTION

It is an object of the present invention to provide a method for flame spraying of gunite on the lining of metallurgical units, which would improve the durability of the material applied to damaged lining and thus prolong the lining life, and which would raise the amount of refractory material adhered to the lining and thus reduce the overall amount of refractory material used for hot patching purposes.

Th foregoing object is attained by providing a method for flame spraying of gunite on the lining of metallurgical units, which comprises a delivery of a mixture of a refractory material and fuel in a central asymmetric flow and a delivery of oxygen in an annular flow concentric with the flow of the refractory material and fuel, heating and fusion of the refractory material in a high-temperature flame, and applying particles of the refractory material to the surface of the lining, wherein oxygen is delivered in a tapering annular flow rotating around its axis, and the ratio between the momentum of the oxygen flow rotation and the momentum of the flow of the refractory material and fuel is maintained at a level of 0.3 to 3.0.

The method according to the invention causes for an intensive mixing of the fuel, refractory material and oxygen due to the rotation of the oxygen flow. The method provides for a combustion of fuel within a limited space and in an immediate proximity to the outlets of the nozzles; it provides for a rapid heating of the refractory material so that the latter can be brought to a plastic state, and ensures a desired speed of directing refractory particles at the surface of the lining being patched.

The method of this invention considerably improves the durability of the material applied to damaged lining, because it optimizes the temeprature at which the refractory material is applied and adheres to the lining. The method makes concentrations and temperatures sufficiently uniform over the cross-section of the flame and increases the amount of refractory material adhering to the lining surface; the latter advantage is due to a rapid and uniform heating of refractory particles in the flame; it is also due to the fact that all refractory particles enter the lining laver at a desired and practically equal speed. Rotation of the flame about its axis increases the flare angle of the flame and accounts for a greater uniformity of concentration, speed and temperature over the cross-section of the flame. The flame of this type is more pliant and contacts the lining surface at a lower angle, as compared with conventional hot patching methods. Patching material sprayed by a rotating flame firmly adheres to the lining.

The durability of the patching layer is increased by 20 to 25 percent. The refractory material consumption is reduced by 20 percent, as compared to the method wherein fuel and refractory material are delivered in parallel flows.

BRIEF DESCRIPTION OF THE ACCOMPANYING DRAWINGS

Other objects and advantages of the present invention will become more apparent from a consideration of the following detailed description of a preferred embodiment thereof, taken in conjunction with the accompanying drawings, wherein.

DISCLOSURE OF BEST MODE OF CARRYING OUT THE INVENTION

Figure 1:
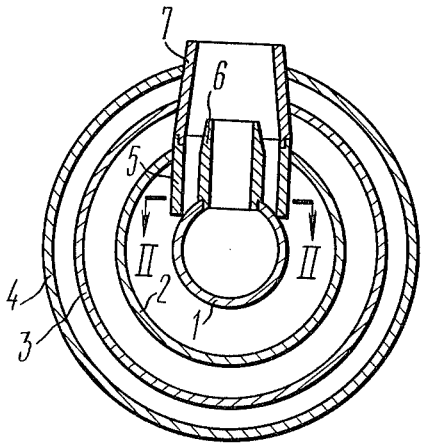
FIG. 1 is a cross-sectional view of the tuyere, taken in the plane of the central axis of the nozzles.
Figure 2:
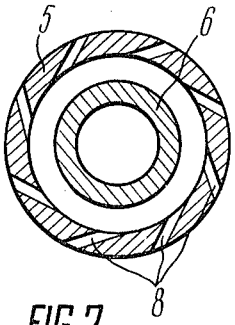
FIG. 2 is a cross-sectional view of the nozzles, taken on line A—A of FIG. 1.

The method for flame spraying of gunite on lining of metallurgical units can be carried out with the aid of a tuyere shown in the attached drawings. The tuyere according to the invention comprises a central tube 1 which serves to deliver a mixture of fuel and refractory material, and a tube 2; the annular gap between the tubes 1 and 2 serves for the delivery of oxygen. The tuyere further includes tubes 3 and 4 which form annular channels for the supply and discharge of cooling water, and a cylindrical bush which serves to rotate the flow of oxygen. The tuyere further contains a central nozzle 6 which serves to deliver a mixture of fuel and refractory material, and a tapering nozzle 7 which serves for the delivery of oxygen. The end of the central nozzle 6 is inside the nozzle 7 that serves for the oxygen delivery. In order to rotate the flow of oxygen, slots 8 (FIG. 2) are provided in the wall of the bush 5 (FIG. 2); these slots are tangential to the cylindrical surface of the central nozzle 6. The device for rotating the flow of oxygen may be of a different type; for example, one may use paddles arranged at a certain angle.

The mixture of fuel and refractory material is passed through the central tube 1. The solid phase is transported by compressed air. Oxygen is delivered through the annular channel between the tubes 1 and 2. The mixture of fuel and refractory material comes out of the central nozzle 6. Through the slots 8, oxygen is fed to the space between the nozzles 5 and 6; as it does so, it is set in rotation around the central nozzle. The flow of oxygen, which moves towards the outlet of the central nozzle and rotation about its central axis, is tangential to the base of the central two-phase flow of the refractory material and fuel. Downstream of the outlet of the central nozzle, the rotating flow of oxygen comes into contact with the two-phase flow of the refractory material and fuel and sets it in rotation. The space between the ends of the nozzles is the zone of intense preliminary mixing of oxygen, fuel and refractory material. The mixing is caused by the rotation of the two flows and the introduction of oxygen into the two-phase flow of the refractory material and fuel, which, in turn, is due to the fact that the oxygen delivery channel tapers toward its outlet. The tapering of the oxygen flow is also meant to prevent losses of oxygen caused by the centrifugal forces. The angle of taper is 10° to 20°. The components are thoroughly mixed after the two flows come out of the respective nozzles. High-temperature gases are drawn into the flows, and the fuel is ignited in immediate provimity to the nozzle outlet. The flame is much shorter than in the case of devices where the components are delivered in parallel flows; the combustion zone thus becomes shorter, too. This means a greater amount of heat is produced per unit of volume and the faster heating of refractory particles. The rotation of the flame makes the speeds, temperatures and concentrations more uniform over the cross-sectional area of the flame. All refractory particles enter the lining at a practically equal speed and temperature. Therefore, less refractory material is entrained in the outgoing flow of combustion products. The rotating flame produced by the tuyere in accordance with the invention is more pliable than the flame produced by conventional methods.

The following examples will serve to illustrate the best modes of carrying out the invention.

EXAMPLE 1

The structure to be repaired is a 300-ton converter.

The internal diameter of the converter is 6.8 m. The lining is formed of tar-bonded magnesite.

The patching is done with a mass comprising 25 percent by weight of coke and 75 percent by weight of magnesite. The particle size of the mixture is not greater than 0.1 mm. The resulting mixture of finely ground coke and magnesite is transported pneumatically; the air consumption for the pneumatic transport system being 2 $m^3$ per 100 kg of coke-magnesite mixture. The lining temperature at the start of the hot patching process is 1,300° C.

Prior to flame spraying, the tuyere is cooled with water and introduced into the converter. The patching is carried out from the center of the converter, by rotating the tuyere about is longitudinal axis. The flame is maintained at a right angle to the lining surface. The tuyere according to the invention, which is used in this case, comprises 12 pairs of nozzles. A mixture of fuel and refractory material is delivered through the central nozzles; oxygen is delivered through the annular channel between the nozzles; the flow of oxygen rotates around the axis of the nozzles. The flow of oxygen comes out of the slots 8 (FIG. 2) at an angle of 80° to the plane extending at a perpendicular to the nozzle axis.

The refractory and fuel consumption is 500 kg/min.

The oxygen consumption is 220 $m^3$/min.

The speed of the oxygen flow at the outlet of the nozzle is 300 m/sec.

The speed of the mixture of fuel and refractory at the outlet of the nozzle is 35 m/sec.

The initial rotational momentum of the oxygen flow is 25 kg·m/sec. The initial momentum of the flow of fuel and refractory is 32 kg·m/sec. The ratio between the rotational momentum of the oxygen flow and the momentum of the flow of fuel and refractory is 0.78.

The combustion zone is shorter, and the flare angle of the flame is greater than in the case of parallel flows of fuel-refractory mixture and oxygen. Refractory particles are heated enough to become plastic before they contact the lining. Uniformly heated refractory particles firmly adhere to the lining and effectively fuse with one another and the lining. Instead of four heats withstood by the original lining, the coating on the cylindrical surface of the converter produced in accordance with the invention can withstand 5 heats; this means the durability of the lining is increased by 20 percent. Up to 90 percent of the magnesite contained in the patching mixture is introduced into the lining, an almost 20 percent increase, as compared to the conventional method. The flame spraying is terminated after a patching layer of a desired thickness is built on the internal surface of the converter. In practice, it takes 3 to 5 minutes to flame-spray the internal cylindrical surface of a 300-ton converter.

EXAMPLE 2

The structure to be repaired is the cone surface of a 300-ton converter.

The diameter of the vessel mouth is 4.1 m.

A special feature about guniting the cone-shaped portion of a 300-ton converter is that the distance between the tuyere axis and the lining surface is reduced from 3.4 m to 2.05 m. This means that the combustion zone has to be shorter so as to make refractory particles plastic before they contact the lining. The tuyere and the consumprion of the patching materials are as in Example 1. However, in order to intensify the rotation of the central two-phase flow and the mixing of the components, the momentum of the two-phase flow is reduced without changing the flow-rate of the refractory and fuel. For this purpose, the consumption of compressed air which is used for the solid phase transportation is reduced from 10 $m^3$/min to 5 $m^3$/min. The rate of mass flow remains the same, but the flow velocity is reduced about two-fold. As a result, the momentum of the central two-phase flow is also reduced two-fold and amounts to 16 kg·m/sec. The parameters of the oxygen flow remain unchanged; the ratio between the rotation momentum of the oxygen flow and the momentum of the central two-phase flow is 1.56. The two-phase flow becomes more pliant because of its reduced speed and is more easily broken by the annular flow of oxygen. The flare angle of the flame increases, and the combustion zone becomes shorter. Besides, the mean mass velocity of the merged flows of oxygen and of refractory and fuel is reduced; all other things being equal, this means that refractory particles take longer to cover the distance between the end of the nozzle and the lining surface. Refractory particles are uniformly heated in the flame and assume a plastic state. The wide-flare flame, directed at an angle to the lining surface, does not destroy or blow out the refractory coating already built on the lining, keeping in mind that the lining is at a distance of 2 meters from the end of the nozzles.

The durability of the lining is raised by 20 percent, i.e. it can endure five heats instead of four for which the original lining was designed. About 85 percent of the magnesite contained in the patching material adheres to the lining, a 15 percent increase over the conventional method. It takes 2 to 3 minutes to gunite the conical portion of the converter; the overall duration of guniting a 300-ton converter is 5 to 8 minutes.

EXAMPLE 3

The structure to be repaired is the roof of a 440-ton open-hearth furnace. The distance between the charging door sills and the roof is 2.2 m in the middle of the furnace and 0.8 to 1.2 m at the front and rear walls.

When flame-spraying the central part of the roof and the areas close to the front and rear walls, the flowrate of the mixture of fuel and refractory is 400 kg/min.

The oxygen consumption is 180 $m^3$/min.

The guniting begins at the charging door sill level. In an open-hearth furnace, the distance between the ends of the nozzles and the roof is much shorter than in a converter and varies over a broad range. When flame-spraying different parts of the roof, the structure of the flame is varied by varying the speed of the flow rotation. Thus a sufficient time is provided for fuel combustion; as a result, refractory particles are heated to a desired temperature and hit the lining at a desired speed. When guniting the center of the roof, the flame must reach as far as possible, for which purpose the speed of rotation is reduced and the flame becomes harsher. The ratio between the rotation momentum of the oxygen flow and the momentum of the flow of fuel and refractory is 1.0. With a constant flowrate of fuel and refractory, the momentum of the central two-phase flow is controlled by varying the flowrate of air used for pneumatic transportation. When flame-spraying the central part of the roof, the air consumption is 8 $m^3$/min. When flame-spraying the inclined portions of the roof, the distance between the ends of the nozzles and the lining decreases, which makes it necessary to intensify the mixing of the components in the limited space at the ends of the nozzles and reduce the length of the flame with a view to reducing its dynamic impact.

The guniting of the inclined portions of the roof is done by a rapidly rotating flame; the ratio between the rotational momentum of the oxygen flow and the momentum of the flow of fuel and refractory is maintained at a level of 2.8.

As a result, the flame becomes funnel-shaped; the fuel combustion and heating of refractory particles take place before the flame hurls these particles against the surface of the lining. The rotation is increased by reducing the compressed air consumption to 2 $m^3$/min. The dynamic impact of such a flame is much weaker than that of a flame with parallel flows of the components. This flame is quite soft, which accounts for a uniform deposition of the refractory material on the lining. Up to 70 percent of the refractory contained in the patching material adheres to the lining to produce a refractory coating which withstands 5 to 7 heats. Guniting the roofs of oxygen-blown open-hearth furnaces enables them to withstand 300 heats instead of the original 220, i.e. increases their life by 36 percent.

The method according to the invention is particularly useful for the repair of damaged or worn-out lining of metallurgical units and is thus applicable to metallurgy and machine building.

The method of this invention is most effective for flame-spraying the lining of hot metallurgical units when the lining temperature is higher than that of fuel ignition.

For example, it is best to repair the lining of a converter immediately after a discharge of steel and slag, when the lining temperature is 1,200° to 1,400° C.

The method according to the invention also can be used for guniting metallurgical units of a cylindrical shape, such as converters and steel-teeming ladles. It is also applicable in the case of guniting flat horizontal and vertical surfaces, such as the lateral walls, hearths and roofs of steel-making, heating and other furnaces.

What is claimed is:

1. A method for flame spraying of gunite on the lining of metallurgical units, comprising:

delivering a mixture of a refractory material and fuel in a central symmetrical flow;

delivering oxygen in a tapering annular flow rotating about its axis and concentric with the flow of said mixture;

heating and fusing said refractory material in a high-temperature flame;

applying particles of said refractory material to the surface of said lining; and the ratio between the rotational momentum of said oxygen flow and the flow momentum of said mixture is 2.8 to form a funnel-shaped flame.

2. A method for flame spraying of gunite on the lining of metallurgical units, comprising:

delivering a mixture of a refractory material and fuel in a central symmetrical flow;

delivering oxygen in a tapering annular flow rotating about is axis and concentric with the flow of said mixture;

heating and fusing said refractory material in a high-temperature flame;

applying particles of said refractory material to the surface of said lining; and the ratio between the rotational momentum of oxygen flow and the flow momentum of said mixture ranges from 0.3 to 3.0.

3. The method of claim 2, wherein the angle of taper of said oxygen flow is in the range of from 10 to 20 degrees.

* * * * *